United States Patent [19]

Geiger

[11] Patent Number: 4,650,190

[45] Date of Patent: Mar. 17, 1987

[54] FLIPPER GAME WITH VARYING DEGREES OF DIFFICULTY

[76] Inventor: Hans Geiger, Walserstrasse 38, D-8980 Oberstdorf, Fed. Rep. of Germany

[21] Appl. No.: 668,870

[22] Filed: Nov. 6, 1984

[30] Foreign Application Priority Data

Nov. 9, 1984 [DE] Fed. Rep. of Germany ..... 3340558

[51] Int. Cl.[4] ..... A63F 7/02

[52] U.S. Cl. ..... 273/121 A; 273/110

[58] Field of Search ..... 273/109, 110, 121 A, 273/122 A, 124 A

[56] References Cited

U.S. PATENT DOCUMENTS 2,791,428 5/1957 McDonald ..... 273/110

3,675,927 7/1972 Gottlieb et al. ..... 273/110

*Primary Examiner*—Richard C. Pinkham

*Assistant Examiner*—Stuart W. Rose

*Attorney, Agent, or Firm*—Paul H. Gallagher

[57] ABSTRACT

A flipper game having a plane-sloped playing plate arranged in a housing on which obstacles for the run of the ball are arranged. The ball enters at the head end of the playing plate and runs in the direction of the slope down to a target opening arranged at the foot end of the playing plate. The slope of the playing plate can be regulated thereby altering the running velocity of the ball for production of varying degrees of difficulty. The slope of the playing plate can be manually set or incremented automatically depending on the score.

4 Claims, 3 Drawing Figures

FLIPPER GAME WITH VARYING DEGREES OF DIFFICULTY

Figure 1:
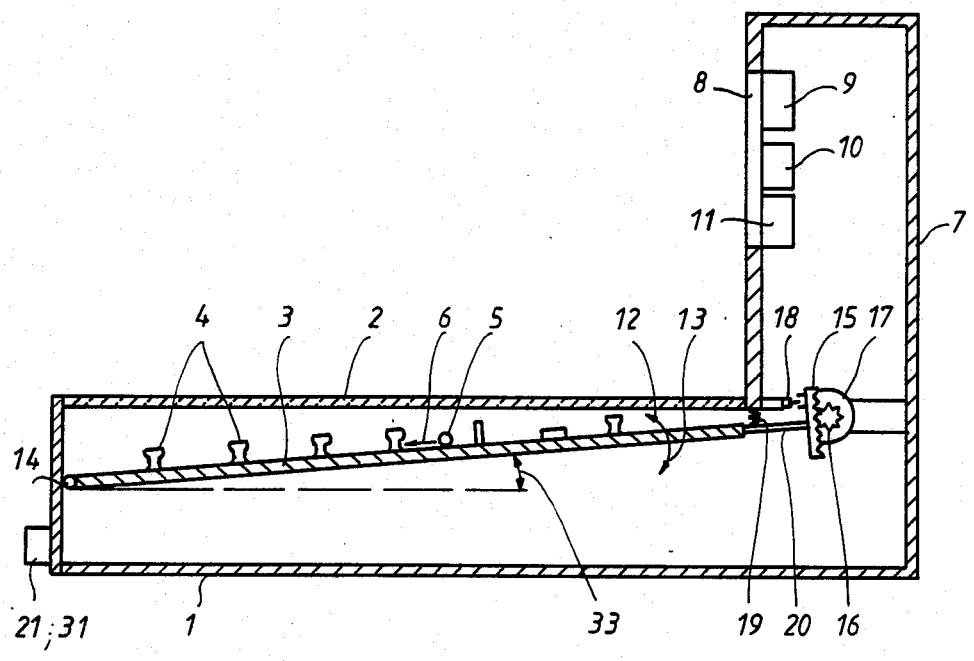

The invention concerns a flipper game, or pinball game, according to the superimposed concept of claim 1. The flipper game mentioned in the introduction is known in different forms. In a first group of forms, the game flow is fully electronically controlled, while in the second group, the game flow is controlled by an electromechanical relay.

Common to both of the foregoing forms is that the player has no influence on the run, or speed, of the game, especially he cannot determine the degree of difficulty or the velocity of the ball.

An object of the present invention is to so build a flipper game of the sort mentioned in the introduction, wherein the game can be adjusted for greater richness and interest.

To that end, the invention is characterized in that the slope of the playing surface is adjustable.

With the given technical range now existing, an entirely new playing effect is reached, in that, since the slope of the playing surface is adjustable, it is possible to vary the velocity of the ball, whereby the game proceeds faster which demands greater concentration from the player.

The variation of the slope of the playing surface can be provided according to different parameters.

In a first form of the invention, provision is made whereby the player from the outset chooses a certain degree of difficulty by means of a manual actuator control, that is, at the outset, a certain slope of the playing surface is selected.

In a second form of the invention, the slope of the playing surface is adjusted as a result of and according to the count of the meter. When for example, the player has reached 8,000 points, then depending on this meter condition, the slope of the playing surface is raised, so that the ball runs faster and thereby a different course of play is achieved.

When two players play against each other, when the second player plays, the playing surface will slope back to its original position and will only then be raised again when this second player has reached a given point accumulation of, for example, 8,000 points.

An especially simple arrangement of the slope of the playing surface is provided in that the playing surface is turnably supported in a swivel support at the foot end, and at the head end, racks are fastened at symmetrical distances and parallel to each other, whose (racks) longitudinal axes are disposed perpendicular to the plane of the plate and which (racks) mesh with a motor driven pinion/shaft.

In order to prevent the playing surface from swinging beyond the desired limit indicated above, preferably a spring limits the playing plate buttressing against the housing. In this manner the slope of the playing surface is controlled.

The described rack-pinion drive assures that the plate will be raised exactly parallel. Instead of the described rack-pinion drive, of course, other parallel drive means can be utilized instead, as for example, an electromagnetic drive, whereby the magnet keeper of a solenoid buttresses at the plate and the solenoid itself buttresses at the housing.

Also, other mechanical driving means are possible, instead as for example, worm drives, hydraulic level drives, and the like.

An especially simple construction results therefore in that the regulating motor is directed to the lifting of the playing plate by a processor, whose (processor) initiation signal conductors are connected with the manual actuator control, the meter and the final circuit for the limiting of the slope of the playing plate. The processor thereby controls all the functions of the slope movement, depending either on the meter count, or the manual actuator control, or the final condition of the circuit.

The objects of the invention do not result solely from the object of the individual patent claims, rather also from the combination of the individual patent claims taken together.

All of the specifications and characteristics disclosed herein, especially the spatial development presented in the drawings, are claimed as essential to the invention, is so far as they individually or in combination now exist with respect to the development of the field.

In the following, the invention is more closely illustrated solely by means of drawings that present a design form. Further characteristics and advantages of the invention will be seen to result from the drawing and their description It shows:

FIG. 1: Longitudinal section through a flipper game according to the invention.

Figure 2:
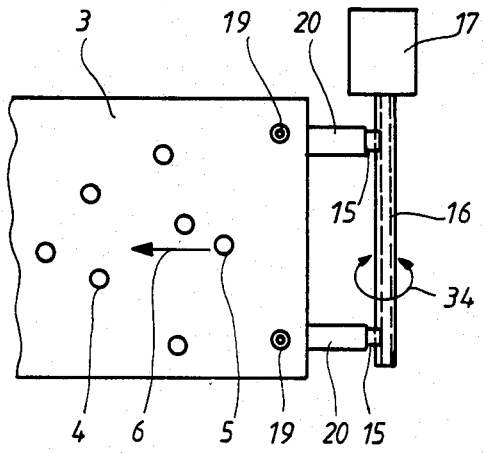

FIG. 2: Overview of the head end of the playing plate with the slope adjusting means.

Figure 3:
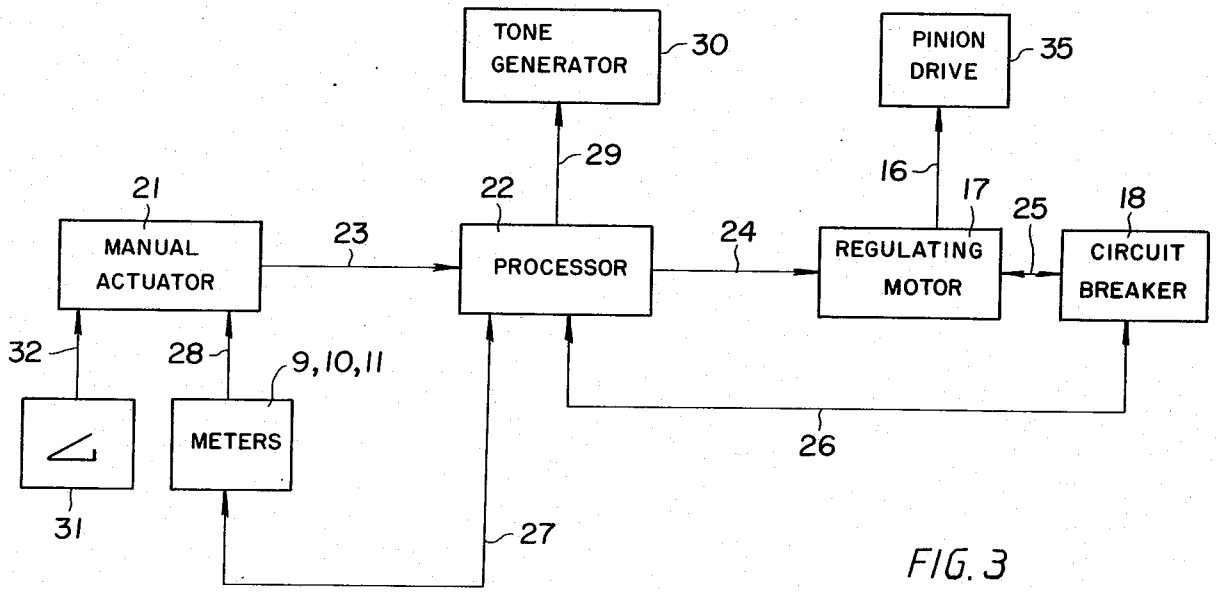

FIG. 3: Schematic representation of the circuit arrangement of the slope adjusting means.

The flipper game according to the invention consists of a box-like housing 1, which on its upper side is covered with a glass plate 2; through the glass plate 2 the playing plate 3 is visible, which consists of a plane plate, on which a row of obstacles 4 are built, between which the ball 5 must meander in the direction of the arrow 6. This arrangement is known and is the object of every flipper game.

In conventional flipper games the playing plate 3 has a fixed slope which is unalterable.

According to the invention, the slope 33 of the playing plate 3 can be altered, by means of the arrangement in which the foot end of the playing plate 3 is held in a swivel support 14 at the forward front side of the housing 1, while the head end of the playing plate 3 is provided with two symmetrically spaced holders 20, on each of which a rack 15 is fastened. The longitudinal axis of the rack 15 is exactly perpendicular to the plane of the playing plate.

Each rack 15 meshes with a pinion/shaft 16, which is driven by a regulating motor 17. By turning the pinion/shaft 16 in the direction of the arrow 34 the playing plate is adjusted in its slope either upward in the direction of the arrow 12 or downward in the direction of the arrow 13. Limiting movement of the slope adjustment can be provided by means of a mechanical catch. In order to switch off the motor after reaching the desired position of the playing plate 3, a circuit breaker 18 is fixedly mounted on the housing, having contact elements engageable with two circuit blocks, which are fastened at the rack 15. After running through a certain shifting displacement of the rack 15, the final circuit breaker 18 is actuated, which then switches off the regulating motor 17.

At the beginning of play, the slope of the playing plate 3 may be set up by means of a manual actuator 21 fixed to the front of the housing 1.

Also, the slope of the playing plate 3 can be adjusted by means of meters 9, 10, 11 fixed in the projecting housing 7 behind a glass plate 8. After reaching a certain high count (accumulation of points), the slope 33 of the playing plate 3 is raised in the direction of the arrow 12, thereby resulting in a greater running velocity of the ball 5 in the direction of the arrow 6.

In order to avoid possible swinging of the playing plate beyond the housing, provision is made that the slope regulating drive works against a coil spring 19.

FIG. 3 shows the electrical driving scheme, in which the regulating motor 17 is driven by a processor 22 by way of a conductor 24. The actuation of the processor 22 is caused by way of a signal conductor 23, which is joined at the manual actuator 21. A conductor 32 leads from the control 31 to the actuator 21, and the signal conductor 23 runs from the control 31, and the signal control 28 runs from the play meter made up of the meters 9, 10, 11, together.

By way of the control 31, the slope 33 of the playing plate 3 can be adjusted. This also can be done by means of the play meter. After reaching a certain point count (accumulation of points) the degree of difficulty is raised, that is, the slope 33 increases, which results by way of the signal conductor 28, the actuator 21 and the signal conductor 23 and the processor 22. The regulating motor 17 is thereby driven and by way of the pinion/shaft 16 drives the pinion drive 35. The pinion drive 35 is made up of the pinion/shaft 16 and the racks 15.

By way of the work connection 25, the regulating motor 17 controls the final circuit 18. The work connection is presented in the example of FIG. 1 or FIG. 2 in the form of two contacts, between which the operation control of the final circuit 18 is set in motion. After reaching the final position of the playing plate 3, either in the direction of the arrow 12 or in the direction of the arrow 13, the regulating motor 17 activates the final circuit 18 and this sends its reverse signal to the processor by way of the signal conductor 26 that the desired slope is attained.

At the processor 22, a further signal conductor 29 may be provided, which works on the tone generator 30. When playing with increased degree of difficulty (increased slope of the playing plate) an audible signal or another additional sound may be generated. Additionally light effects may be produced.

In analagous way, the processor 22 is driven also by way of the signal conductor 27 of the meters 9, 10, 11, which after reaching a certain accumulation of points, cause the processor to drive the regulating motor 17 by way of the conductor 24, in order to cause an increased slope of the playing plate 3. Not shown are the reverse conductors, which effect the resetting of the playing plate when a new game begins.

LEGENDS

1. housing
2. glass plate
3. playing plate
4. obstacle
5. ball
6. direction of the arrow
7. housing
8. glass plate
9. meter
10. meter
11. meter
12. arrow direction
13. arrow direction
14. pivot support
15. rack
16. pinion/shaft
17. regulating motor
18. final circuit
19. coil spring
20. holder
21. manual actuator
22. processor
23. signal conductor
24. conductor
25. work connection
26. signal conductor
27. signal conductor
28. signal conductor
29. signal conductor
30. tone generator
31. actuator control
32. signal conductor
33. slope
34. arrow direction
35. pinion drive

I claim:

1. A flipper game including a housing, and a tiltable playing plate in the housing having an upper head end and a lower foot end, the playing plate having obstables thereon in the run of a ball which enters at the head end and rolls down toward a target opening at the foot end, and the flipper game includes meters registering score points made in the playing of the game, wherein, the flipper game includes means responsive only to a predetermined increase of said score points for the slope of the playing plate during a player's turn

2. A flipper game according to claim 1, wherein, the flipper game includes manual actuator means for adjusting the slope of the playing plate.

3. A flipper game according to claim 1, wherein, the playing plate is pivotally supported at its lower foot end, the flipper game includes means supporting the upper head end of the playing plate including transversely spaced racks having longitudinal directions perpendicular to the playing plate, and the flipper game additionally includes a motor for driving shafts with pinions thereon for actuating said racks and thereby adjusting the slope of the playing plate.

4. A flipper game according to claim 3, wherein, the flipper game includes an electrical processor responsive to signals from the manual actuator means and from the meters for controlling said motor, and circuit means for limiting the increase of the slope of the playing plate.

* * * * *